United States Patent [19]

Sutton

[11] Patent Number: 5,021,729

[45] Date of Patent: Jun. 4, 1991

[54] DIFFERENTIAL CURRENT SOURCE

[75] Inventor: John F. Sutton, Greenbelt, Md.

[73] Assignee: The United States of America as represented by the Administrator of the Administration National Aeronautics and Space, Washington, D.C.

[21] Appl. No.: 418,373

[22] Filed: Oct. 6, 1989

[51] Int. Cl.[5] ..... G05F 1/12

[52] U.S. Cl. ..... 323/311; 323/312

[58] Field of Search ..... 323/311, 312, 316, 909

[56] References Cited

U.S. PATENT DOCUMENTS

| | | | |
|---|---|---|---|
| 4,451,779 | 5/1984 | Griep | 323/312 |
| 4,585,987 | 4/1986 | Prue et al. | 323/909 |
| 4,618,814 | 10/1986 | Kato et al. | 323/281 |
| 4,812,781 | 3/1989 | Regnier | 330/257 |

FOREIGN PATENT DOCUMENTS

| | | | |
|---|---|---|---|
| 794624 | 2/1981 | U.S.S.R. | 323/312 |

OTHER PUBLICATIONS

Bailey, "Nanoampere Current Source is Adjustable, Stable, Inexpensive," Elect. Design, vol. 29, No. 2, pp. 134–136, Jan. 22, 1981.

"Differential Current Driver," NASA Tech Brief No. MSC-16475, Winter 1977.

*Primary Examiner*—William H. Beha, Jr.

*Attorney, Agent, or Firm*—R. Dennis Marchant; Harold W. Adams; Ronald F. Sandler

[57] ABSTRACT

A differential, voltage-controlled current source, employing operational amplifiers as the active elements, provides an essentially symmetrical, differential, high impedance drive to a load, the drive being isolated from any circuit common or system ground. Because of the "floating" differential drive and the identical source impedances of the two outputs, errors from common mode voltages are eliminated.

15 Claims, 2 Drawing Sheets

DIFFERENTIAL CURRENT SOURCE

ORIGIN OF THE INVENTION

The invention described herein was made by an employee of the United States Government, and may be manufactured and used by or for the Government for government purposes without the payment of any royalties thereon or therefor.

TECHNICAL FIELD

This invention pertains to current sources and, more particularly, to differential voltage-controlled current sources.

PRIOR ART

In the prior art, several types of current sources have been devised for various purposes. Ordinary fixed unipolar and bipolar current sources are described, for example, in Applications of Operational Amplifiers, Third Generation Techniques, by J. G. Graeme, McGraw-Hill, 1973, Chapter 3, in Operational Amplifiers, Design and Applications, by Tobey, Graeme, and Huelsman, McGraw-Hill, 1971, Chapter 1, and in Modern Operational Circuit Design, by John I. Smith, John Wiley & Sons, 1971, Chapter 12.

The prior art includes a simple current source consisting of an n-channel JFET, the drain of which is connected to a grounded load. The JFET source is connected through a resistor to a negative supply voltage which is also connected directly to the JFET base. If the load resistance is changed to a smaller value, more current will tend to flow, resulting in a larger voltage drop across the source resistor which, in turn, changes the JFET bias so as to increase the effective resistance of the JFET. This results in the total circuit impedance remaining relatively constant, which, in turn, results in a relatively constant current flow. With minor modifications, this simple current source can be made to be voltage-controlled.

Another prior art current source is a single-ended, voltage-controlled current source. It consists of a simple operational inverting amplifier circuit in which the functional load resistance is incorporated as the feedback resistance. The input current is determined by the input voltage and input resistor. This same input current must flow through the feedback-load resistance, but is largely independent of that load resistance.

These circuits, and the many variations on them of varying complexity and performance, produce relatively constant currents to either grounded or ungrounded loads, but they do not address the problem of providing a differential current drive to floating loads. This differential drive capability is important, for example, in instrumentation systems where common mode voltages, i.e., those voltages developed, in the case of the instant invention, across a resistive connection between a measurement sensor and a measurement instrument, can cause errors in precision measurements. A known example of a differential current drive in the prior art is the circuit described in NASA Tech Brief #MSC-16475, Winter 1977. This circuit provides differential output, i.e., two identical, opposite-phase outputs, but drives one end of the load from a zero source impedance. This effectively introduces an ac ground at one terminal of the load. Thus, as will be shown below, this circuit does not eliminate common mode error voltages.

STATEMENT OF THE INVENTION

Accordingly, it is an object of this invention to provide an improved, voltage-controlled current source.

It is another object of this invention to provide an improved, very high output impedance, voltage-controlled current source.

It is yet another object of this invention to provide an improved, voltage-controlled current source having a differential output with opposite phase, substantially equal, high impedance outputs.

It is still another object of this invention to provide an improved, voltage-controlled current source having a floating differential output.

Briefly, these and other objects are achieved by providing an improved differential current source where a load may be driven by a floating, high impedance, differential output of the source.

DETAILED DESCRIPTION OF THE INVENTION

Figure 1:
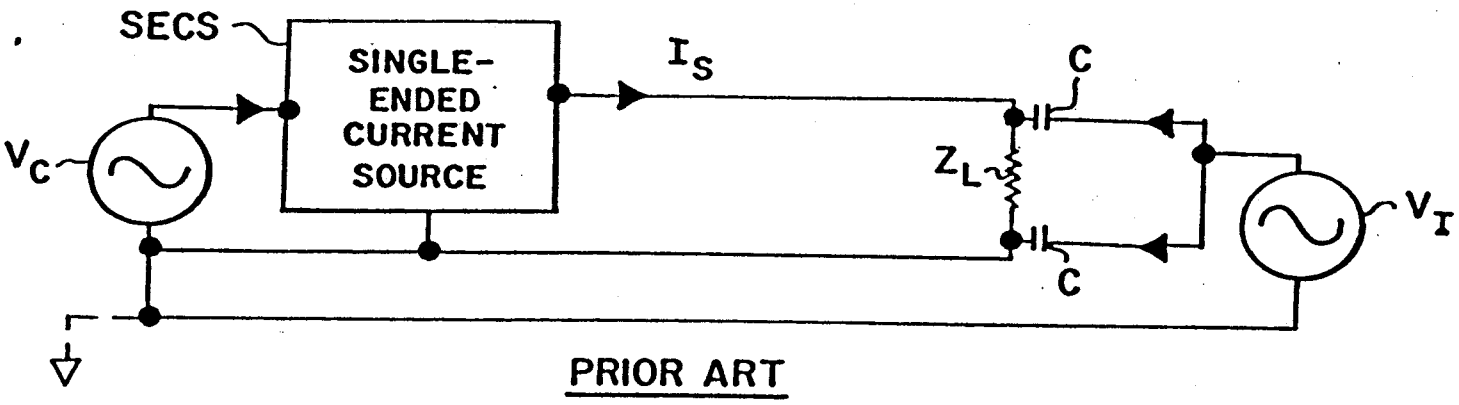
PRIOR ART FIG. 1
FIG. 1 is a block diagram illustrating a prior art, single-ended current source.
Figure 2:
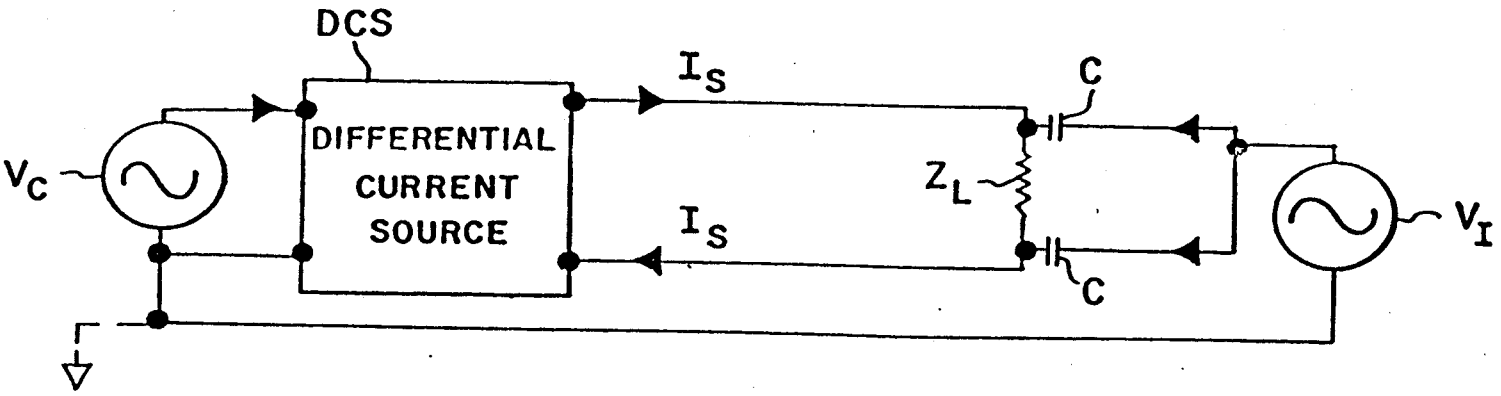
FIG. 2 is a block diagram illustrating a system employing a differential current source according to the instant invention.

FIGS. 1 and 2 are provided to illustrate the difference between a single-ended current source and a differential current source and, additionally, to show how the improved differential current source eliminates errors due to common mode voltages. In FIG. 1, a single-ended current source, SECS, driven by a control voltage, $V_C$, is shown in a circuit configuration wherein the source is used to drive a current, $I_S$, through a load impedance, $Z_L$. An independent, common mode interference signal voltage, $V_I$, originating in an adjacent electric power cable, for example, drives stray capacitances, C, and causes an interference current to flow through $Z_L$, resulting in the generation, by Ohm's law, of a corresponding error voltage drop across $Z_L$. In FIG. 2, the common mode interference voltage drives the stray capacitances, C, but, because both ends of $Z_L$ are connected to identical high output impedances, and because of the symmetry of the differential current source, DCS, no current caused by the interference voltage can flow through $Z_L$, and, therefore, no corresponding error voltage drop can be developed across $Z_L$. Note that the DCS is a four terminal device in which the two outputs are isolated from $V_C$ and from circuit common. Also, unlike the one known case of the prior art in which one output has zero source impedance, the output circuits of the instant DCS are high impedance and symmetrical. The rejection of the effects of interference-generated voltages is important in cryogenic thermometry systems, for example, where $Z_L$ is a temperature sensing element known as a germanium resistance thermometer (GRT), and where such interference-generated voltages could otherwise cause errors in the precision measurement of temperatures.

Figure 3:
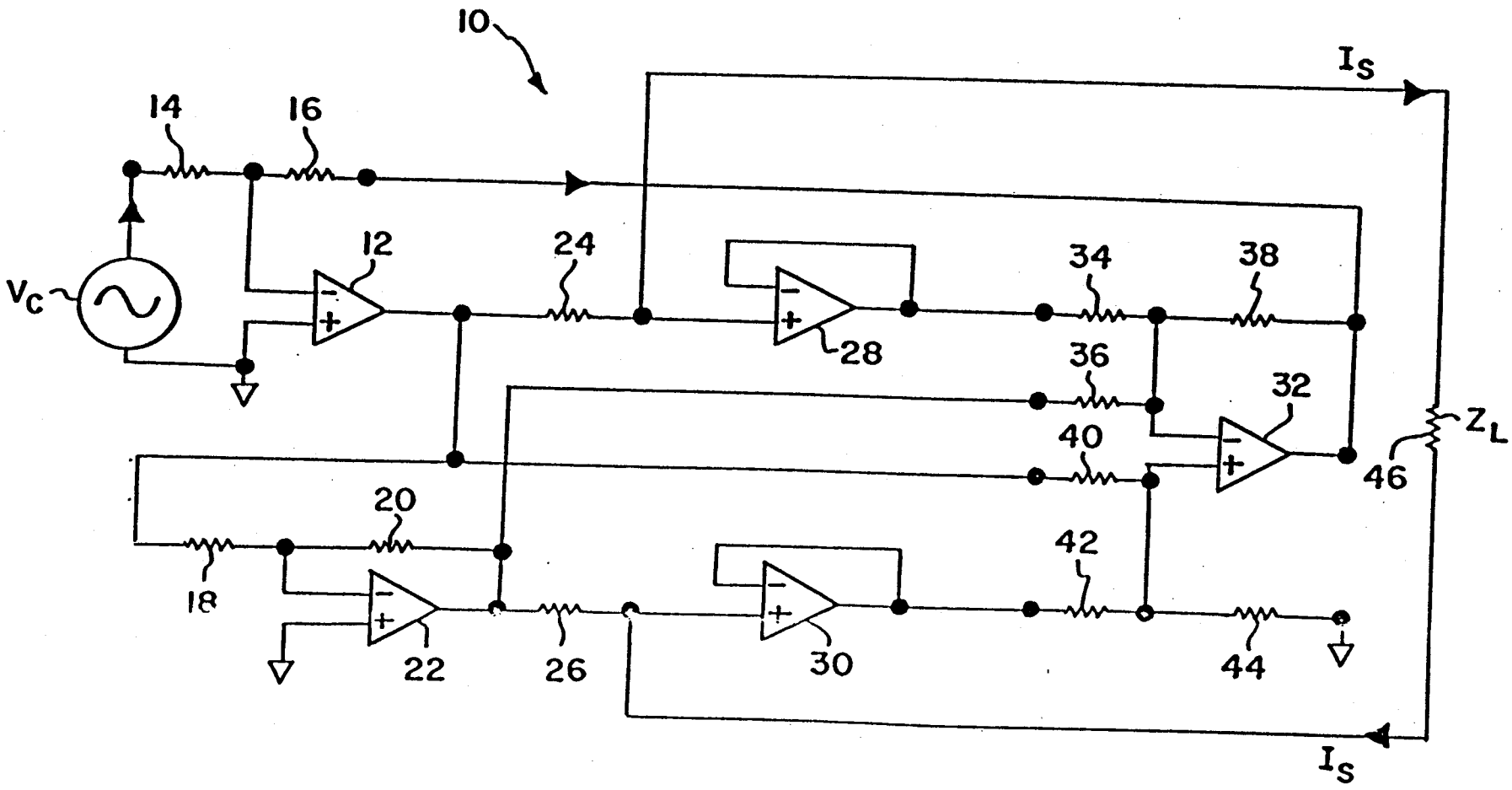
FIG. 3 is a schematic diagram of the floating differential current source of the instant invention.

One embodiment of the instant invention, employing only operational amplifiers and resistors, is shown in the schematic diagram of FIG. 3 as circuit 10. Circuit 10 is, in essence, a combination of individual operational amplifier circuits in a symmetrical configuration. Operational amplifier (OA) 12 may be viewed essentially as a unity gain, inverting amplifier, but, because resistor 16 is not connected to the output of OA 12, but rather to the output of another element, it, in reality, operates as a feedback control amplifier. This will be explained more fully later in this discussion. The junction of resistor 14 and resistor 16 is connected to the inverting input of OA 12 while the noninverting input is connected to the circuit 10 common which, may be, but need not be, a system ground. The other terminal of resistor 14 is the circuit input. Likewise, the common terminal of the junction of resistor 18 and resistor 20 is connected to the inverting input of OA 22, with the noninverting input also being connected to the circuit common. Operational amplifier OA 22 is also configured as a unity gain, inverting amplifier. The output of OA 12 is connected to the other terminal of resistor 18, while the other terminal of resistor 20 is connected to the output of OA 22.

Resistors 14, 16, 18, and 20, all have a magnitude of 10k ohms and OA 12 and OA 14 are both OP-77s, manufactured by Precision Monolithics, Inc. (PMI) of Santa Clara, Calif. The outputs of both OA 12 and OA 22 are connected to one terminal of reference resistors 24 and 26, respectively, both of which have the magnitude of 50k ohms, while the other terminals of resistors 24 and 26 are connected to the noninverting inputs of OA 28 and OA 30, respectively. The magnitudes of the resistances of the reference resistors 24 and 26 are usually selected to set the magnitude of the output current for a given magnitude of the input signal, $V_C$. The inverting terminals of OA 28 and OA 30 are connected, respectively, to the outputs of OA 28 and OA 30. Thus configured, OA 28 and OA 30 each constitute a unity gain, noninverting, buffer amplifier with essentially infinite input impedance and essentially zero output impedance. Accordingly, regardless of the voltage impressed on the noninverting inputs of OA 28 and OA 30, no current will flow into OA 28 or OA 30 but the voltage impressed on these noninverting inputs will be reproduced at the OA 28 and OA 30 outputs.

Operational amplifier (OA) 32 is configured as a four-input, unity-gain, differential summing amplifier. The output of OA 28 and the output of OA 22 are connected to one terminal of resistor 34 and 36, respectively. The other terminals of resistors 34 and 36 are commonly connected to both the inverting input of OA 32 as well as one terminal of resistor 38. The other terminal of resistor 38 is connected to both the output of OA 32 and the terminal of resistor 16 which does not form a junction with resistor 14. The output of OA 12 and the output of OA 30 are connected to one terminal of resistors 40 and 42, respectively. The remaining terminals of resistors of 40 and 42 are connected in common to the noninverting input of OA 32 and are also connected in common to one terminal of resistor 44. The second terminal of resistor 44 is connected to the circuit common. Resistors 34, 36, 38, 40, 42, and 44, all have a magnitude of 10k ohms.

One terminal of the load impedance 46 is connected to the noninverting input of OA 28 and the other terminal of load impedance 46 is connected to the noninverting input of OA 30. The load impedance is not connected in any way to the circuit common.

The input to this circuit, driven by control voltage $V_C$, is the terminal of resistor 14 which is remote from the terminal of resistor 14 which is connected in common with resistor 16. If the input terminal is at circuit common potential, then the outputs of OA 12, OA 22, OA 28, OA 30, and OA 32 are all at circuit common potential. Both terminals of the load impedance will also be at circuit common potential, and, accordingly, no current will flow through the load. If a positive potential with reference to circuit common is applied to the input, the output of OA 12 will swing negative. This will drive the output of OA 22 positive by the same amount. As a result of the presence of the voltages at the outputs of operational amplifiers 12 and 22, current will flow through the reference resistors 24 and 26 and through the load resistance 46. The voltage drops across the reference resistors 24 and 26 are then summed by the summing amplifier composed of OA 32 and resistors 34, 36, 38, 40, 42, and 44. The OA 28 and OA 30 amplifiers provide buffering so that resistors 34 and 42 do not introduce errors due to loading. Finally, the output voltage from OA 32 appears as the feedback voltage at resistor 16 which closes the control system loop. Because the feedback voltage produced at the output of OA 32 is proportional to the total voltage drop across the reference resistors 24 and 26, which, in turn, is proportional to the load current $I_S$, the loop comes to equilibrium when $I_S$, is directly proportional to the input voltage $V_C$ and independent of the resistance of the load resistance $Z_L$.

If $V_C$ is negative, instead of positive, with respect to circuit common, the direction of $I_S$ will be reversed from the direction of current flow which exists when the input voltage is positive with respect to circuit common. In general, $I_S$ will be directly proportional to $V_C$. In one application of the instant invention, $V_C$ is a sinusoid having a fixed amplitude and fixed frequency. In this case, $I_S$ is a sinusoidal current of the same frequency and independent of the magnitude of load impedance $Z_L$. The magnitude of $I_S$ is determined only by the circuit constants and the magnitude of $V_C$.

The overall operation of the differential current source may be readily understood by noting the following. Operational amplifier OA 12 may have an extremely high input impedance, as in the case, for example, of an operational amplifier having a JFET input stage. Because the noninverting input of OA 12 is connected to circuit common, the summing junction of OA 12 is a virtual common. This means that the current through resistor 14 is determined only by $V_C$ and the value of the resistance of resistor 14. Because none of the current through 14 can flow into the inverting input of OA 12, it must all flow through resistor 16. If the resistance of 14 equals the resistance of 16, then by Ohm's law applied to the resistance divider formed by resistors 14 and 16, the voltage at the output of OA 32 must have the same magnitude, but the opposite polarity of $V_C$. Operational amplifier OA 32 and resistors 34, 36, 38, 40, and 42 are configured as a unity gain differential summing amplifier. Because the inputs of the summing amplifier represent the total voltage drop across the reference resistors 24 and 26, the output of OA 32 is a voltage proportional to this total voltage drop. By Ohm's law, again, the output of OA 32 is therefore proportional to the current, $I_S$, through load resistor 46. Thus, the differential current source may be viewed simply as an inverting amplifier circuit incorporating an operational amplifier where the feedback voltage is derived by sensing the current in the load.

To understand how the differential current source is unaffected by a common mode voltage, assume that $V_C$ is zero, and that a common mode voltage is applied to both ends of load resistor 46 with respect to circuit common. Because both ends of resistor 46 are at the same potential and connected to equal impedances, no current will flow through resistor 46 as a direct result of this interference voltage. Current can flow back from the upper terminal of resistor 46 through resistor 24 to the zero source impedance of the output of OA 12. Similarly, current can flow from the lower terminal of 46, back through resistor 26 to the zero source impedance of the output of OA 22. Because resistors 24 and 26 are identical, identical voltage drops will be developed across 24 and 26. These identical error voltages are summed with opposite polarities, and therefore cancelled out by the four-input differential summing amplifier, resulting in no resulting change in the output of OA 32. Thus, the application of a common mode voltage to the two terminals of load resistor 46 results in no change in the current through 46.

If $V_C$ is not zero, the two terminals of the load resistor, $Z_L$, are driven to equal and opposite voltages with respect to circuit common. The superposition of the common mode voltage onto this differential voltage to $Z_L$ again causes equal error currents to flow back through resistor 24 to the output of OA 12 and also back through resistor 26 to the output of OA 22. As before, the identical voltage drops across resistors 24 and 26 are summed to zero by the summing amplifier and, as before, the result of the application of a common mode voltage to the load resistor is no change in the load current, $I_S$.

I claim:

1. A current source including:

load driving means for driving a voltage-controlled current through a floating load, at any given instant, by equal and opposite potentials, from equal impedance sources included in said means, when said floating load is isolated from any circuit common;

means for connecting said load driving means to said floating load; and, means for connecting said load driving means to a control voltage to provide said voltage-controlled current through said floating load, said load driving means further including feedback control means for sensing current in said floating load and for feeding back a signal proportional to said sensed load current to provide, in turn, a current in said load which is independent of the impedance of said load and responsive to said control voltage;

whereby common mode voltages applied to said floating load are insubstantial sources of error.

2. The current source of claim 1, wherein said voltage source is variable and said voltage-controlled current is variable.

3. The current source of claim 1, wherein said equal impedance sources are high impedance sources.

4. The current source of claim 1, wherein said means to drive a load includes a plurality of operational amplifiers.

5. The current source of claim 1, wherein said equal and opposite potentials are derived from essentially symmetrical drive circuitry.

6. A voltage-controlled, differential current source, including:

five interconnected operational amplifier circuits, four of which amplifiers drive separate inputs, respectively, of the fifth amplifier, the output of said fifth amplifier, in turn, driving an input of one of said four amplifiers, said one of said four amplifiers including an input means which is connectable to a voltage source, and the inputs to a different two of said four amplifiers including an output means which is connectable to a load.

7. The voltage-controlled, differential current source of claim 6, wherein the voltage-control is obtained by applying said voltage source to said input means.

8. The voltage-controlled, differential current source of claim 6, wherein said fifth amplifier is configured as a differential summing amplifier.

9. A voltage-controlled, differential current source, including:

a first operational inverting amplifier circuit having input means connectable to a voltage source and driving a second operational inverting amplifier circuit as well as a third operational noninverting amplifier circuit;

said second operational inverting amplifier circuit driving a fourth noninverting operational amplifier circuit; and, said first, second, third, and fourth operational amplifier circuits driving a fifth operational, differential summing amplifier circuit, the inputs to said third and fourth amplifiers including means which are connectable to a load.

10. The voltage-controlled, differential current source of claim 9 wherein said third and fourth operational amplifier circuits are buffers.

11. The voltage-controlled, differential current source of claim 9 wherein said first and second operational amplifier circuits have unity gain.

12. The voltage-controlled, differential current source of claim 9 wherein said first and second operational amplifier circuits are connected to inputs of said third and fourth operational amplifier circuits, respectively, by intervening resistors.

13. The voltage-controlled, differential current source of claim 12, wherein a load impedance is connectable to said current source between said intervening resistors and inputs of said third and fourth operational amplifier circuits.

14. The voltage-controlled, differential current source of claim 9, wherein the output of said fifth operational amplifier is connected to said first operational amplifier.

15. The voltage-controlled, differential current source of claim 14, wherein said output is a feedback control signal.

* * * * *